US006854640B2

(12) United States Patent
Peklo

(10) Patent No.: US 6,854,640 B2
(45) Date of Patent: Feb. 15, 2005

(54) REMOVABLE COIN BIN

(75) Inventor: John C. Peklo, Elmhurst, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 126 days.

(21) Appl. No.: 10/251,211

(22) Filed: Sep. 20, 2002

(65) Prior Publication Data

US 2004/0055902 A1 Mar. 25, 2004

(51) Int. Cl.[7] ..... G07G 1/00

(52) U.S. Cl. ..... 235/100; 235/379; 235/381; 232/15; 232/31; 206/0.815; 194/351; 902/9

(58) Field of Search ..... 235/100, 379, 235/381; 902/8, 9, 11, 13; 194/350, 351; 206/0.8, 0.815, 0.82, 0.83, 0.84; 232/12, 15, 31, 66

(56) References Cited

U.S. PATENT DOCUMENTS

| | | | | |
|---|---|---|---|---|
| 3,416,337 A | | 12/1968 | Hutchins | 70/284 |
| 3,843,043 A | * | 10/1974 | Sciortino | 232/15 |
| 3,903,721 A | | 9/1975 | Aaron | 70/423 |
| 4,380,316 A | | 4/1983 | Glinka et al. | 232/16 |
| 4,534,492 A | | 8/1985 | Schwarzli | 221/203 |
| 4,545,475 A | * | 10/1985 | Fillod et al. | 194/350 |
| 4,557,282 A | | 12/1985 | Childers et al. | 133/3 A |
| 4,964,495 A | | 10/1990 | Rasmussen | 194/344 |
| 5,044,483 A | * | 9/1991 | Stefan | 194/350 |
| 5,097,934 A | | 3/1992 | Quinlan, Jr. | 194/200 |
| 5,100,708 A | * | 3/1992 | Heyes et al. | 428/36.91 |
| 5,390,515 A | | 2/1995 | Essick | 70/63 |
| 5,469,951 A | | 11/1995 | Takemoto et al. | 194/206 |
| 5,607,102 A | * | 3/1997 | Walsh et al. | 232/15 |
| 5,619,932 A | | 4/1997 | Efland et al. | 109/24.1 |
| 5,620,079 A | | 4/1997 | Molbak | 194/217 |
| 5,768,760 A | * | 6/1998 | Citron et al. | 29/430 |
| 5,799,767 A | | 9/1998 | Molbak | 194/217 |
| 5,813,510 A | * | 9/1998 | Rademacher | 235/379 |
| 6,082,519 A | | 7/2000 | Martin et al. | 194/350 |
| 6,264,545 B1 | | 7/2001 | Magee et al. | 453/3 |
| 6,494,776 B1 | * | 12/2002 | Molbak | 453/32 |

FOREIGN PATENT DOCUMENTS

| | | | |
|---|---|---|---|
| JP | 10-110561 A * | 4/1998 | |
| WO | WO99/00776 | 1/1999 | G07F/9/06 |

OTHER PUBLICATIONS

Complaint, *Cummins–Allison Corp.* v. *Glory Ltd., Glory Shoji Co. Ltd., and Glory(U.S.A.) Inc.*, Civil Action No. 02C–7008, United States District Court, Northern District of Illinois, Eastern Division, Oct. 2002.

Billcon Corporation, Brochure for CCS–60/CCS–80 Series Coin Counter–Sorter, 2 pages (Oct. 1999).

Billcon Corporation, Photos for CCS–60/80, 1 page (Japanese language) (Oct. 12, 2000).

(List continued on next page.)

*Primary Examiner*—Jared J. Fureman
(74) *Attorney, Agent, or Firm*—Jenkens & Gilchrist

(57) ABSTRACT

Briefly, in accordance with the foregoing, the invention is related to a removable coin storage apparatus being used in a coin processing device, which comprises a bin, a cover, a gate, and a sloped floor. The bin comprises a first opening and a second opening, wherein a cover is used for the first opening. To allow the placement of coins inside the bin, the cover is movable between a closed position wherein the cover substantially covers the first opening, and an open position wherein the cover at least partially uncovers the first opening. The gate is proximate the second opening, and is movable between an up position and a down position, the up position at least partially uncovering the second opening to allow the coins to be discharged from the bin, the down position substantially covering the second opening.

20 Claims, 8 Drawing Sheets

OTHER PUBLICATIONS

De La Rue Cash Systems, Inc., Brochure for ACD Automatic Coin Dispenser, 2 pages, no date.
De La Rue Cash Systems, Brochure for MACH 12 Coin Sorter/Counter, 2 pages (1999), no month.
De La Rue Cash Systems, Brochure for MACH 12HD Coin Sorter/Counter, 2 pages, no date.
Glory, Brochure for GSA–500 Sortmaster, 2 pages, no date.
Magner, Brochure for COINSTREAM™ CPS 502 Self–Service Coin Processing System, 2 pages, no date.
Magner, Brochure for MAG II 100 Series Coin Sorters, 2 pages, no date.
Magner, Brochure for MAG II Model 915 Coin Counter/Packager, 2 pages, no date.
Magner, Brochure for Pelican 305 Coin Sorter, 2 pages, no date.
Magner, Brochure for 900 Series Coin Counters and Packagers, 2 pages, no date.

* cited by examiner

REMOVABLE COIN BIN

FIELD OF THE INVENTION

This invention is directed generally to coin handling devices and, more specifically, to a removable coin bin for use in a coin redemption machine.

BACKGROUND OF THE INVENTION

Coin storage devices are widely used in a variety of coin processing machines, such as coin redemption machines, automated teller machines (ATMs), vending machines, gaming machines, and toll booth machines. Regardless of whether these coin processing machines are designed to perform one function, such as counting a number of coins, or several functions, such as counting, sorting, and identifying the coins, all coin processing machines usually require a convenient device for storing the coins after they have been processed. Some examples of such storage devices are bins, bags, trays, boxes, containers, and other similar devices.

According to one particular need, some coin processing machines may require the use of more than one storage device. For example, if sorting is relevant, a coin processing machine may output the coins to two or more storage devices, sorting the coins by denomination. If in a particular application the weight of the stored coins is of concern, then the coin processing machine may distribute the processed coins to two or more storage devices to avoid having a single, heavier storage device.

The design of the storage devices must generally take in account at least two factors: the easy removal of the coins, for further processing such as depositing in a bank, and the unauthorized removal of the coins, for preventing theft. Furthermore, some storage devices are designed to permit easy removal after being partially filled, while others are designed to permit easy removal only after being completely filled.

One problem that exists in some prior art devices is that manual intervention is required to remove the coins from the storage device, wherein an operator physically removes small amounts of coins at a time until the entire amount of coins has been removed. Aside from being time consuming, the manual intervention is also susceptible to the loss of coins, either through the operator losing or stealing coins.

Another problem that exists in some prior art devices is that transportation of a storage device is extremely difficult. Because some of these storage devices can weigh hundreds of pounds, such as around 500 pounds, it might take more than one person to lift and transport a storage device. The transportation difficulty becomes even more troublesome if the storage device is located in a hard-to-get position, such as in a container designed to tightly enclose the storage device. Unless the storage device is designed for allowing a single person to easily transport the heavy load, the process of transporting such a storage device can become unduly cumbersome, if not nearly, impossible. Similarly, some prior art devices are inadequate because they are not specifically designed to facilitate transportation by using commercially available transportation machines, such as a hand-operated truck, a motorized truck, or a forklift.

Yet another problem that occurs in some prior art devices is that the security of the coins might be compromised. Some prior art devices do not have locks, relying instead on the integrity and honesty of the operators. Other prior art devices require at least two locks, a lock for the door used to deposit the coins and a lock for the door used to remove the coins. Consequently, the tasks in removing and depositing coins double, wherein each lock must be locked and unlocked. Furthermore, an operator must keep track of two different keys or combinations. Other prior art devices are secure, but the security is provided at the expense of simplicity, efficiency, and cost. For example, one prior art device is available that uses a key in a coin processing machine to automatically lock and close a coin storage device when it is removed from the coin processing machine, and to automatically unlock and open it when it is inserted into the coin processing machine. Seemingly convenient, this type of device is not only expensive, but it also adds extra components that require maintenance, and that limit the use of the coin storage device to a limited number of coin processing machines.

Therefore, an object of the present invention is to provide a coin storage device that is designed to facilitate the easy removal of coins. Another object of the present invention is to provide a coin storage device that is easy to transport. Yet another object of the present invention is to provide a single secure and simple locking feature for a coin storage device.

SUMMARY OF THE INVENTION

Briefly, in accordance with the foregoing, the invention is related to a removable coin storage apparatus for use in a coin processing device, which comprises a bin, a cover, a gate, and a sloped floor. The bin includes a bin comprising a first opening and a second opening, wherein the a cover is used for the first opening. The cover is movable between a closed position, wherein the cover substantially covers the first opening, and an open position, wherein the cover at least partially uncovers the first opening, to allow the placement of coins inside the bin through the first opening. Near the second opening the bin contains the gate which is movable between an up position and a down position, the up position at least partially uncovering the second opening to allow the coins to be discharged from the bin, the down position substantially covering the second opening. Additionally, the sloped floor is located inside the bin, preferably having a plurality of planes which help in providing a gravity-induced flow of the coins from the first opening to the second opening.

In another embodiment of the present invention, the coin apparatus includes a pivoting handle for manual transportation of the coin apparatus, which can be used to easily move the coin apparatus from one place to another. Therefore, in contrast to other prior art devices, the handle is part of the coin apparatus for simple and easy movement of the coin apparatus to different locations.

In another embodiment, the coin apparatus includes a single-locking mechanism for securing the coin apparatus when it is not being used. Although some prior art devices require the use of a separate locking mechanism for each a coin input opening and a coin removal opening, one embodiment of the present invention includes a single-locking mechanism that enables a user to secure the coin apparatus.

Another embodiment of the present invention includes a forklift feature for lifting the coin apparatus during transportation. The forklift feature eliminates at least one step in moving the coin apparatus, i.e., the placement of the coin apparatus on the forklift.

In yet another embodiment, the present invention includes a plurality of compartments for such uses as the depositing of coins in coin bags. The removal of coins from only one compartment can be more difficult than the removal of coins from bags placed in several compartments. The bags are in general small and lightweight, allowing an operator to easily lift them out of the coin apparatus.

DETAILED DESCRIPTION OF THE ILLUSTRATED EMBODIMENT

Figure 1A:
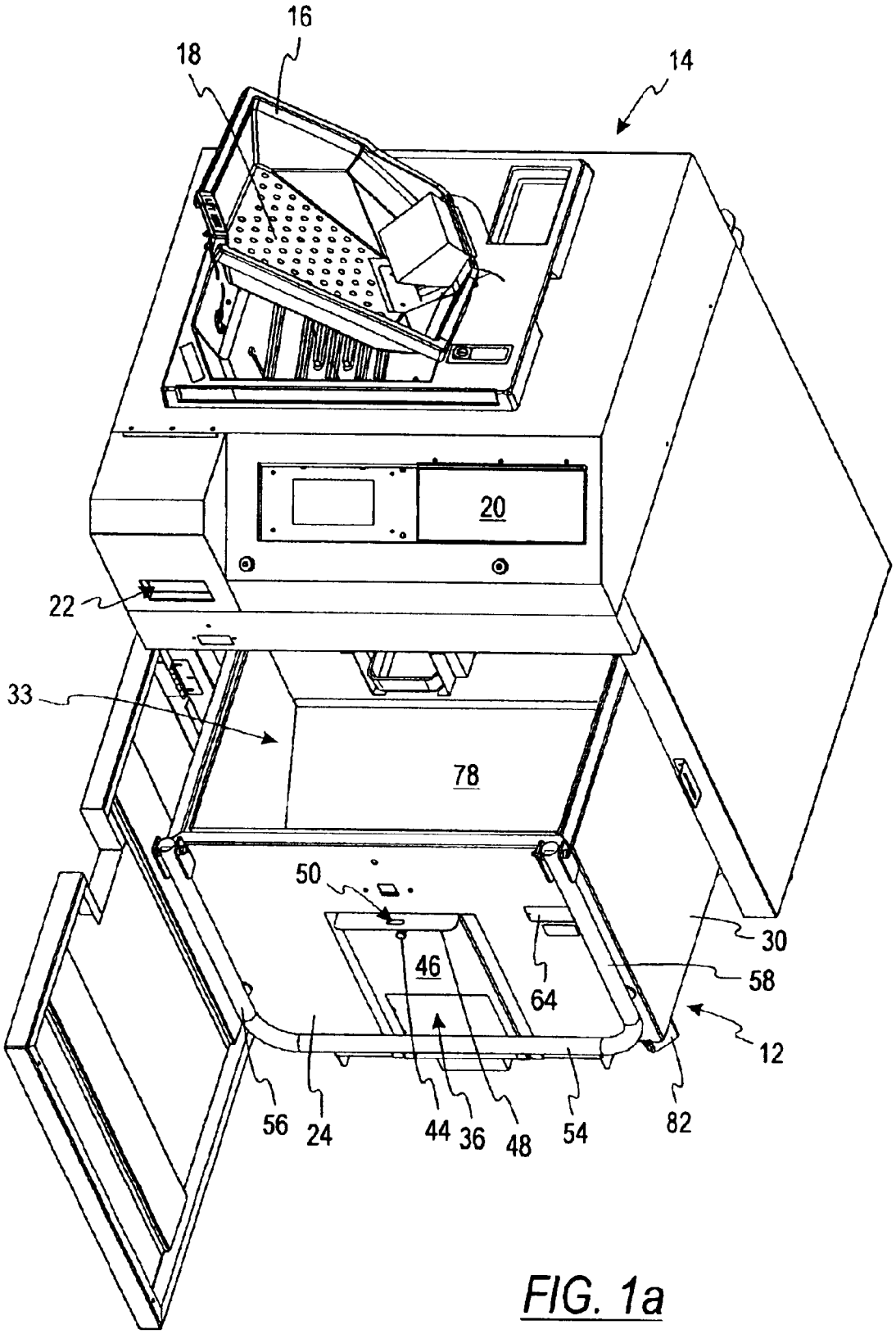
FIG. 1*a* is a perspective view of a removable coin bin according to one embodiment of the present invention as used in a coin processing machine.
Figure 1B:
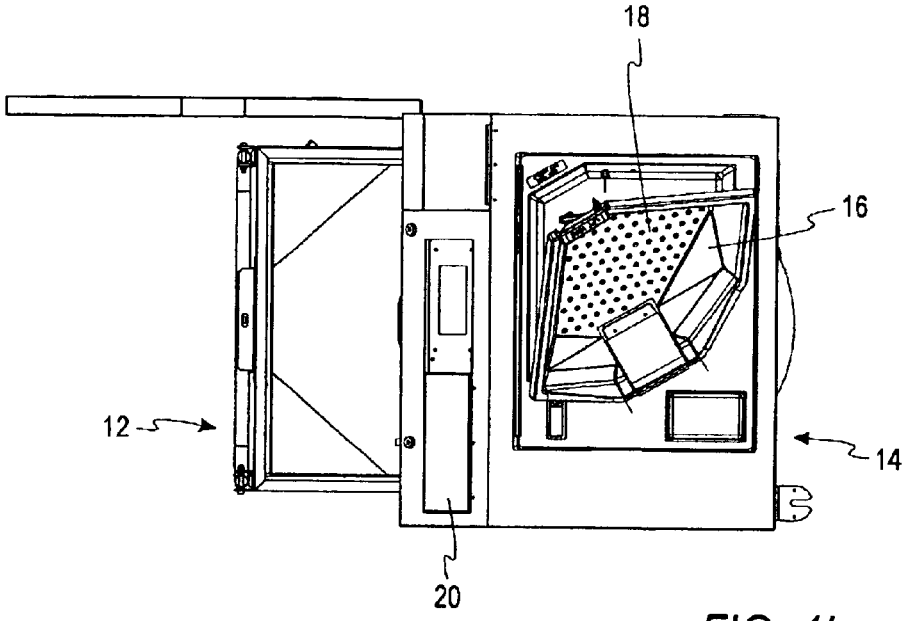
FIG. 1*b* is a plan view of FIG. 1*a;*
Figure 1C:
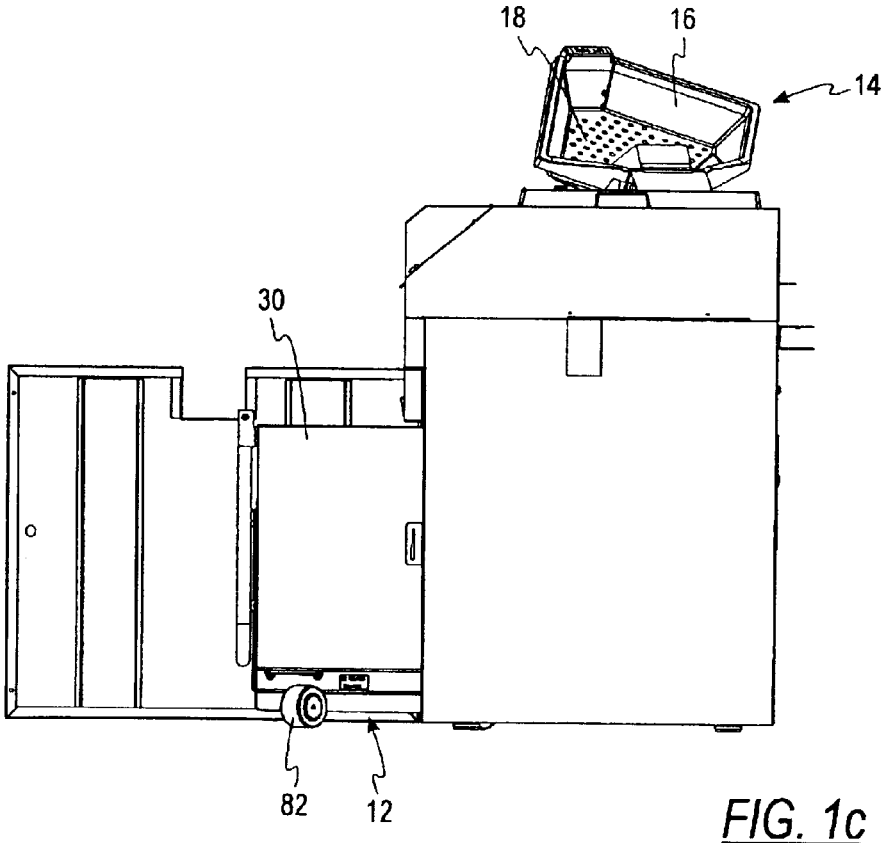
FIG. 1*c* is an end view of FIG. 1*a;*

Referring now to the drawings, and initially to FIGS. 1*a*–1*c*, a removable coin bin 12, i.e., a removable coin storage apparatus, according to the present invention is shown in usage with a coin processing device or machine 14. A detailed description of the coin bin 12 will be provided after a brief description of the coin machine 14. Note that the term coin machine 14 includes such machines as a coin redemption machine, automatic teller machine (ATM), coin counter, coin sorter, funds processing machine, vending machine, toll-booth machine, and a gambling machine. Also, the term coin is meant to include United States currency coins, international currency coins, and all types of tokens.

The coin machine 14 includes a coin input area 16 which receives coins of mixed or single denomination from a user. The coin input area 16 allows the user of the coin machine 14 to deposit the user's coins which will ultimately be converted to some other sort of fund source (e.g., banknotes, credit to a smartcard, credit to an account, credit for purchases in the store containing the coin machine 14, etc.) that is available to the user. The coin input area 16 includes a coin tray that has a perforated plate 18, which helps to direct the coins to a coin processing area within the coin machine 14. A coin tray similar to that described which may be used in connection with the coin input area 14 of the coin machine 14 is described in greater detail in U.S. Pat. No. 4,964,495 entitled "Pivoting Tray For a Coin Sorter," which issued on Oct. 23, 1990 and is incorporated herein by reference in its entirety.

A touch screen 20, or other user-input device, is included in the frontal area of the coin machine 14 to provide inputs from the machine user and to display outputs for viewing by the user. In addition to the touch screen 20, the coin machine 14 may also include a mechanical keyboard or buttons to receive such inputs.

The coin machine 14 further includes a media slot 22 into which the user may insert an account card (e.g., a bank card such as an ATM card, an identification card including the type distributed by grocery stores, smartcards, etc.). The media slot 22 is coupled to a media reader device or a media reader/writer device in the coin machine 14 that is capable of reading from or writing to one or more types of media including ATM cards, credit card, smartcards, or other types of media cards. This media may include various types of memory storage technology such as magnetic storage, solid state memory devices, and optical devices. The touch screen 20 typically provides the user with a menu of options which prompts the user to carry out a series of actions for identifying the user by displaying certain commands and requesting that the user depress touch keys on the touch screen 20 (e.g., a user PIN, account number, etc.).

In general, the coin machine 14 receives coins through the coin input area 16, and after these deposited coins have been processed (e.g., authenticated, counted, or sorted), the coin machine 14 outputs a receipt to the user indicative of the dollar amount of the deposited coins. For example, the user of the coin machine 14 may input $20.50 in various coins and the coin machine 14 prints a receipt indicating that $20.50 worth of coins have been processed. The user can redeem the receipt for funds from an attendant of the coin machine 14. An attendant may include a store employee such as a cashier at a grocery store or a teller at a bank. Alternatively, the user can redeem the receipt for credit towards purchases at the store where the machine is located and exchange for merchandise at the store. Alternatively still, the coin machine 14 credits a user's account such as a bank account or an account associated with a store credit card, a store "rewards" program card or a coupon-type card which a user produces at the time of purchase for discounts. Further, a commission may be charged for the use of the machine. Alternatively still, a bonus may be added onto the amount redeemed. For example, a store may desire to have a promotion to attract users into a store whereby by an amount (e.g., a percentage of the coins processed) in addition to the dollar amount of coins processed, an user receives credit towards purchases at the store. Additionally, the receipt can include other information such as a transaction number and totals for each coin denomination.

A coin redemption machine similar to the coin machine 14 that was described above, which may be used in connection with the coin bin 12, is described in greater detail in U.S. Pat. No. 5,982,918 entitled "Automatic Funds Processing System," which issued on Nov. 9, 1999 and is incorporated herein by reference in its entirety.

Figure 2A:
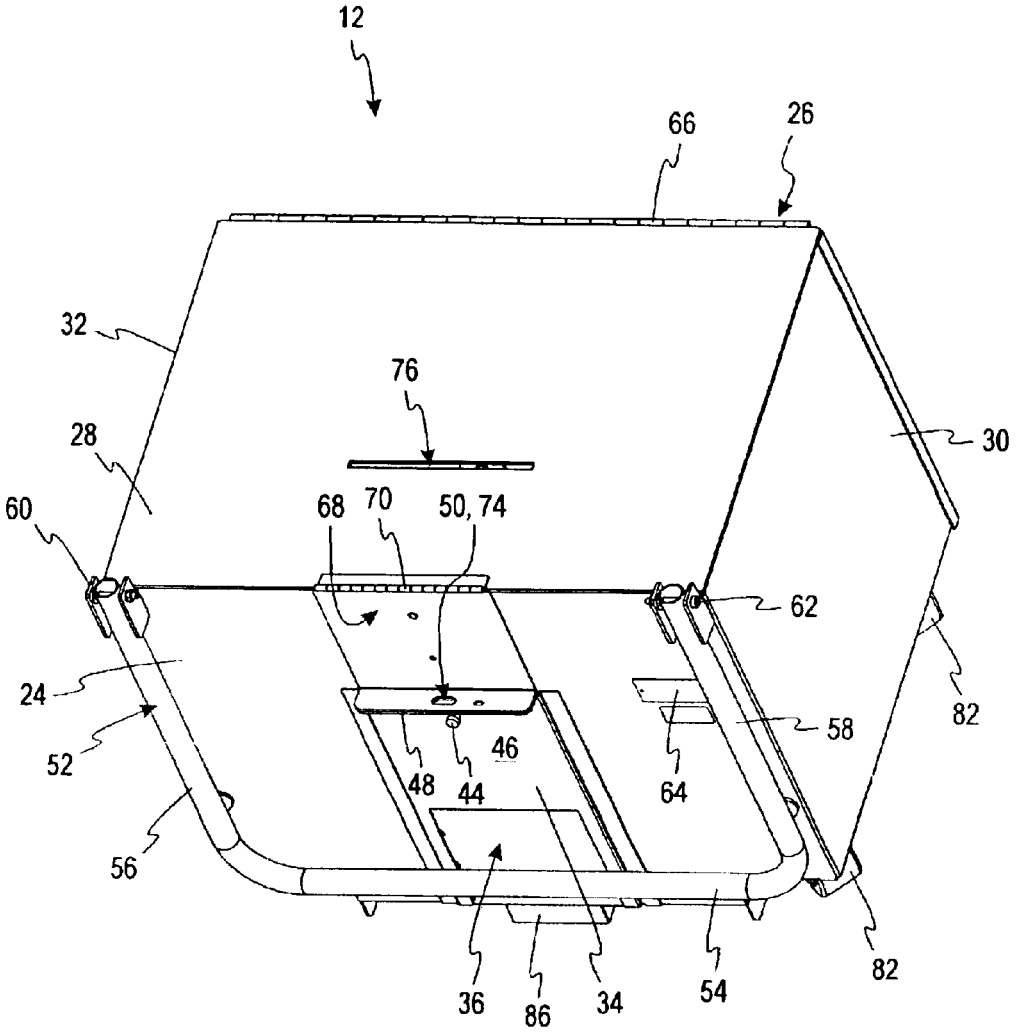
FIG. 2*a* is a perspective view of the embodiment shown in FIG. 1*a* having a cover over the first opening through which coins enter the bin.
Figure 2B:
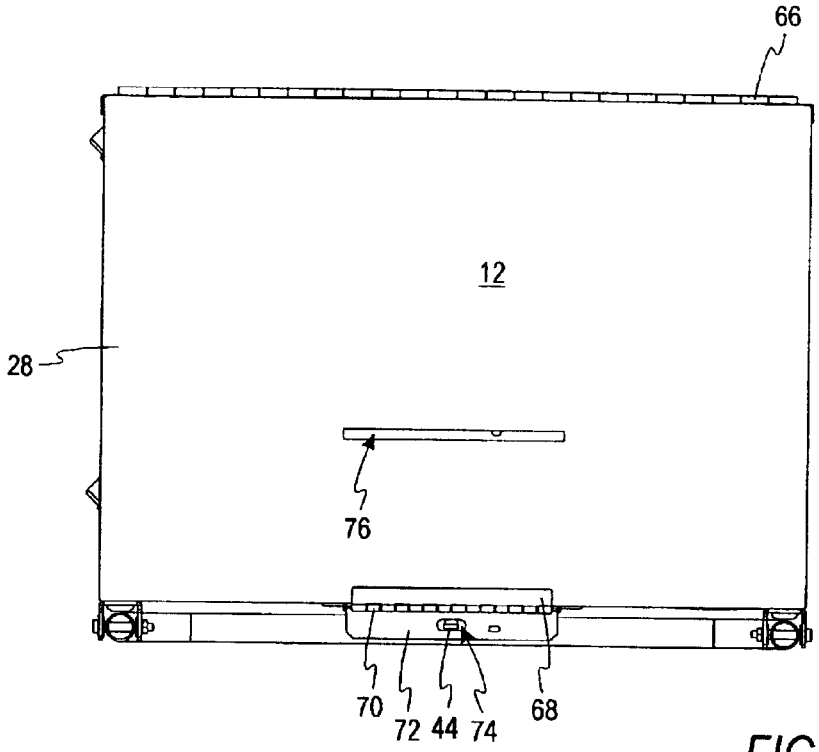
FIG. 2*b* is a plan view of FIG. 2*a;*
Figure 2C:
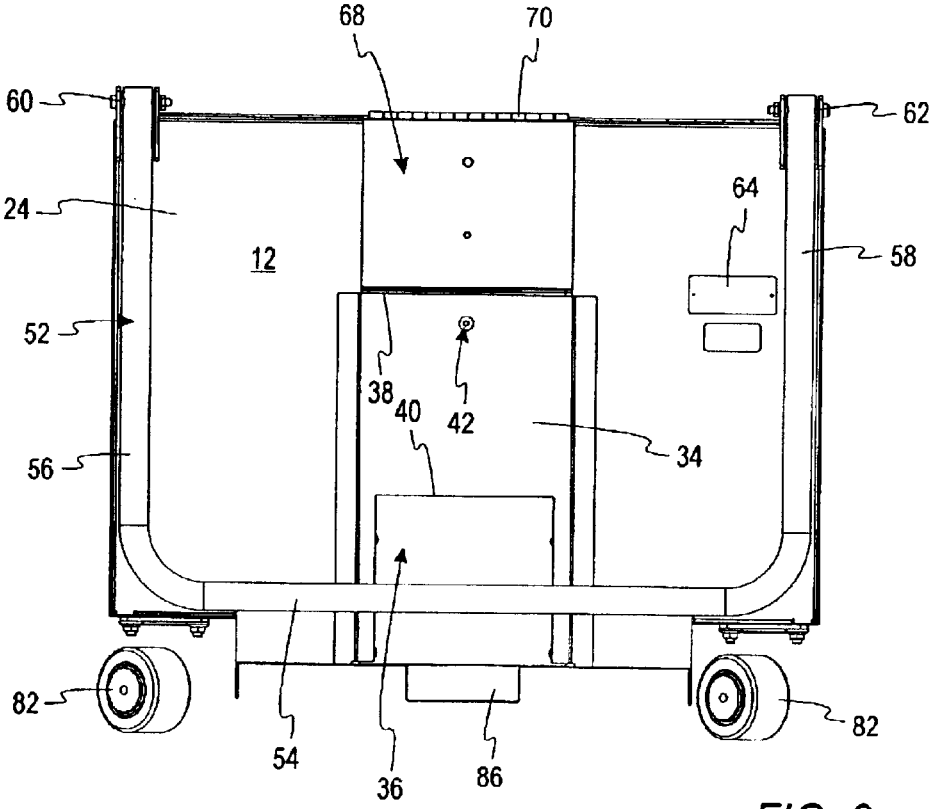
FIG. 2*c* is a front view of FIG. 2*a.*

Referring to FIGS. 1*a*–1*c* and also to FIGS. 2*a*–2*c*, one embodiment of the coin bin 12 will be described in detail. The coin bin 12 is structurally a bin or receptacle having the general shape of a box, which includes a front plate 24, a back plate 26, and a cover plate 28 that is connected to the back plate 26 A first side plate 30 and a second side plate 32 are rigidly connected to the front plate 24 and the back plate 26, forming the basic structure of the coin bin 12 and a coin depositing opening 33 (shown in FIG. 1*a*).

The front plate 24 includes a pocket 34 centrally located between the first side plate 30 and the second side plate 32, and a coin removal opening 36 located below the pocket 34. The pocket 34 is vertically oriented along the front plate 24, with its width being parallel to the cover 28, and it protrudes out of the front plate 24. Also, the pocket 34 has a first open end 38 and a second open end 40, and it includes a pin hole 42 located proximate the first open end 38 The coin removal opening 36 is located next to the second open end 40 and it has a generally rectangular shape with a width smaller than the width of the pocket 34. An adjusting pin 44 is connected to the pocket 34 and can be inserted into the pin hole 42.

A door or gate 46 (better shown in FIG. 1*a*) is a generally rectangular plate that includes at least one adjusting hole and a gate ridge 48, which has a first locking hole 50 located in a central position. The gate 46 slides through the pocket 34 and functions to release coins when their removal is desired, having a down position, which shuts off the coin removal, and an up position, which allows the removal of coins. In other words, the up position at least partially uncovers the coin removal opening 36, while the down position substantially covers the coin removal opening 36. The up position can have different settings, allowing an attendant the flexibility to adjust the removal rate of the coins. The pin 44 is used to fix the gate 46 in a particular setting, as desired by the attendant, by protruding through one of the adjusting holes located in the gate 46. To release coins, the attendant pulls the pin 44, raises the gate 46 to the desired setting by lining up one of the adjusting holes, if there are more than one, with the pin hole 42, and then pushing the pin 44 into both the pin hole 42 and the adjusting hole to fix the gate 46 in the up position. Consequently, the coins inside the coin bin 12 are ready for removal. For a higher coin removal rate the pin 44 should be inserted into an adjusting hole that is located further away from the gate ridge 48, while for a lower coin removal rate the pin 44 should be inserted into an adjusting hole that is located closer to the gate ridge 48. To prevent the removal of coins, the attendant pulls the pin 44 and lowers the gate 46 until the coin removal opening 36 is completely covered by the gate 46.

The front plate 24 preferably includes a handle 52 which is C-shaped and is made from a tube, such as a circular pipe. The handle 52 has in general three sections, a middle section 54 and two lateral sections 56, 58, each of the lateral sections being connected to the front plate 24 at a first pivoting point 60 and a second pivoting point 62. The handle 52 has two main positions, a collapsed position, as shown in FIGS. 2*a*–2*c*, and a transporting position (not shown). A purpose of the collapsed position is to make the coin bin 12 more compact, making sure that the handle 52 does not interfere with the coin processing or the coin removal. In the collapsed position, the handle 52 rests against the front plate 24, having the middle section 54 being positioned near the coin removal opening 36. A purpose of the transporting position is to allow the user the flexibility to move the handle 52 to a position that best fits the user's physical anatomy. For example, a taller person may lift the handle 52 higher than a shorter person. In the transporting position the handle 52 is pivoted upwards, by having an user raise the middle section 54 until the user reaches a comfortable position for using the handle 52 to push or pull the coin bin 12.

In other embodiments the front plate also includes identification plates 64 which are located near the second pivoting point 62. The identification plates 64 can be used to identify relevant information regarding the coin bin 12 or the coin machine 14, such as the coin bin model, the coin machine model, the owner of the coin bin 12, or the owner of the coin machine 14, etc. In other embodiments the identification plates 64 can be located in a different location, such as next to the first pivoting point 60 or next to the pocket 46.

The cover 28 is a lid that pivots on one end to the back plate 26 by using a first hinge 66 that covers nearly the entire width of the cover 28. The first hinge 66 allows the cover 28 to swing between an open position (FIG. 1*a*) and a closed position (FIG. 2*b*). In the closed position the cover 28 substantially covers the coin depositing opening 33, while in the open position the cover 28 at least partially uncovers the coin depositing opening 33. The coins are deposited or placed in the coin bin 12 through the coin depositing opening 33. The width of the cover 28 is the dimension of the cover 28 that is parallel to an imaginary straight line between the first side plate 30 and the second side plate 32, although it can be smaller.

The cover 28 includes a locking plate 68 that is connected to the cover 28 with a second hinge 70. Because the locking plate 68 is hinged to the cover 28, it is free to pivot around the second hinge 70 having in general a locked position and an unlocked position. In general, the locking plate 68 is a rectangular plate having a ridge 72 at one end. The ridge 72 has a second locking hole 74 which is centrally located on the ridge 72, and which has the same general size and shape as the first locking hole 50. Similarly, the ridge 72 has the same general size and shape as the gate ridge 48. When the locking plate 68 is in the locked position, the ridge 72 fits generally over the gate ridge 48 having the second locking hole 74 line up with the first locking hole 50 on the gate 46. Consequently, the locking plate 68 and the gate 46 can be locked using a single locking device, such as a padlock. Therefore, the present invention contemplates a single-locking mechanism comprising the locking plate 68, the gate 46, and a single locking device that locks both openings to the coin bin 12.

Additionally, the cover 28 also includes a long slot 76 which is located in a generally central position for holding the locking plate 68 in a fixed position via a detent mechanism. When the cover 28 is in the open position, the long slot 76 can be used to prevent the locking plate 68 from interfering with the deposit of coins, by holding the locking plate 68 in a stationary position that does not interfere with the coin depositing opening 33. For example, the locking plate 68 can be swung upwards in a clockwise motion and laid flat on the cover 28 having the ridge 72 protruding through the long slot 76, wherein the ridge 72 can be temporarily secured in the long slot 76 using a detent mechanism or structure, e.g., a spring-loaded pin. The, long slot 76 can also be used for the insertion of miscellaneous items after the coin bin 12 is locked by the user. Very often, for security reasons, the person transporting the coin bin 12 from one place to another cannot unlock it. However, additional items may have to be placed inside the coin bin 12, such as additional coins or verification receipts, after the coin bin 12 is locked. For example, when a person transporting the coin bin 12 delivers the bin 12, a verification receipt describing the status of the coin bin 12 (e.g., where the coin bin 12 was brought from, how much money is supposed to have, the name and signature of the transporting person, etc.) can be inserted through the long slot 76. Also, the long slot 76 can function as a visual check for an attendant to see how many coins are inside the coin bin 12, i.e., whether the coin bin 12 is full or empty.

Referring now to FIGS. 3*a*–3*d*, the coin bin 12 includes, in another embodiment, an interior sloped surface 78. The sloped surface 78 contains a plurality of planes which are arranged in angled positions that allows the coins to flow freely toward the coin removal opening 36 under the force of gravity. In one embodiment, the sloped surface 78 can be achieved by bending a single plate to achieve the desired plurality of planes. In another embodiment, the sloped surface 78 can be achieved by connecting a number of different plates, using commonly known means such as welding, soldering, or fasteners. The sloped surface 78, using the force of gravity, eliminates the necessity for manual intervention during the operation of removing coins. After the user opens the gate 46, the coins fall through the coin removal opening 36 until the coin bin 12 is completely empty or until the user closes the gate 46. In one embodiment the sloped surface 78 contains three planes (FIG. 3*b*): two symmetrical side planes that are located on either side of the coin removal opening 36 and that have a triangular shape, and a larger central plane. One side of each of the side planes is connected to the interior of the front plate 24, while another side is connected to the respective one of the first side plate 30 and the second side plate 32. The remaining side of each of the side planes forms a common side with the central plane. The central plane has a parallelogram shape, which has a large parallel side, a small parallel side, and two equal connecting sides. Each of the connecting sides form a common boundary with one side of the side planes. The small parallel side forms the bottom edge of the coin removal opening 36, while the large parallel side is connected to the back plate 26.

Figure 3A:
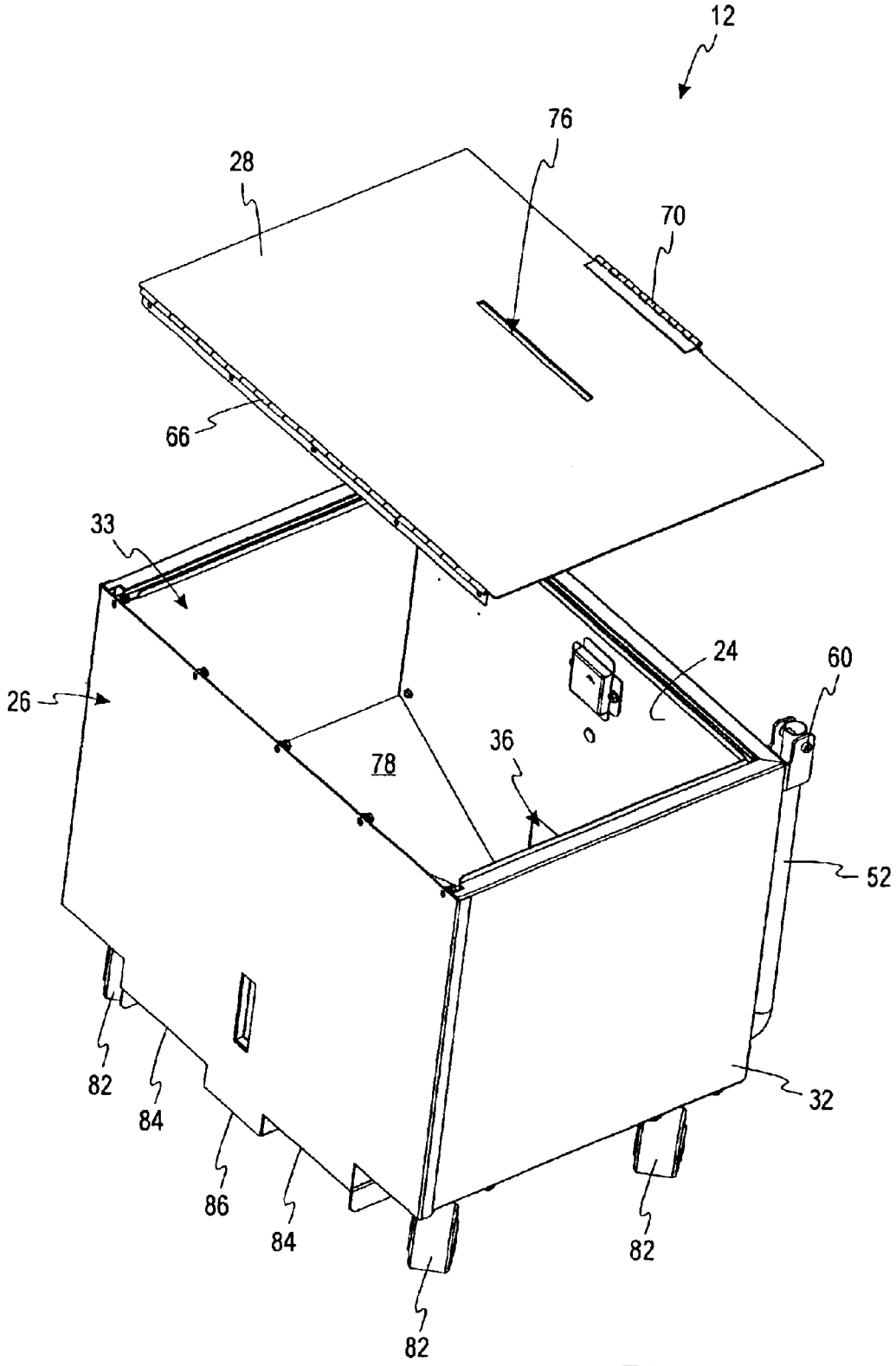
FIG. 3*a* is an exploded back-perspective view of the embodiment shown in FIG. 1*a;*
Figure 3B:
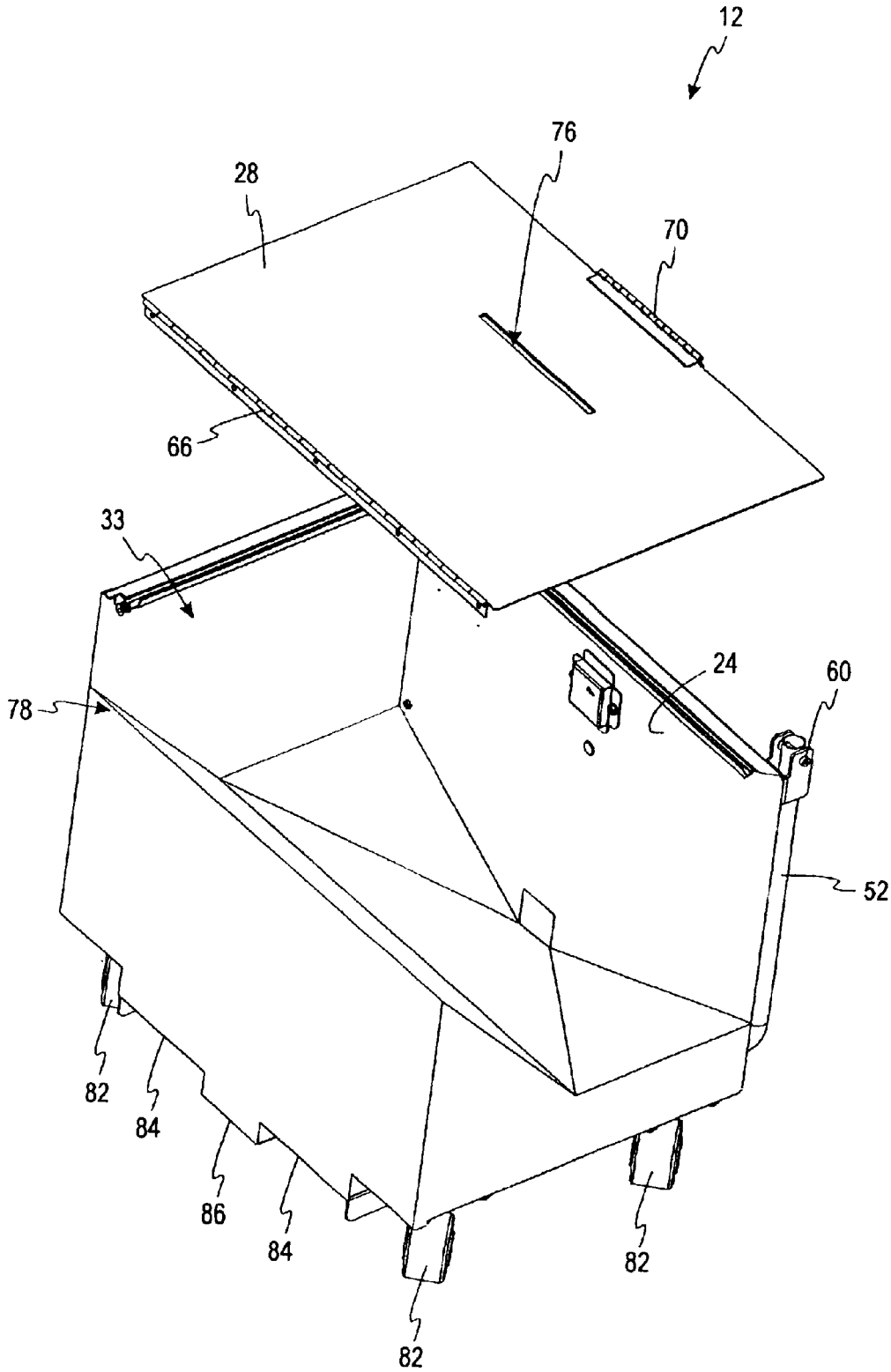
FIG. 3*b* is the same as FIG. 3*a* except that a side and a back plate are removed to show a sloped interior surface.
Figure 3C:
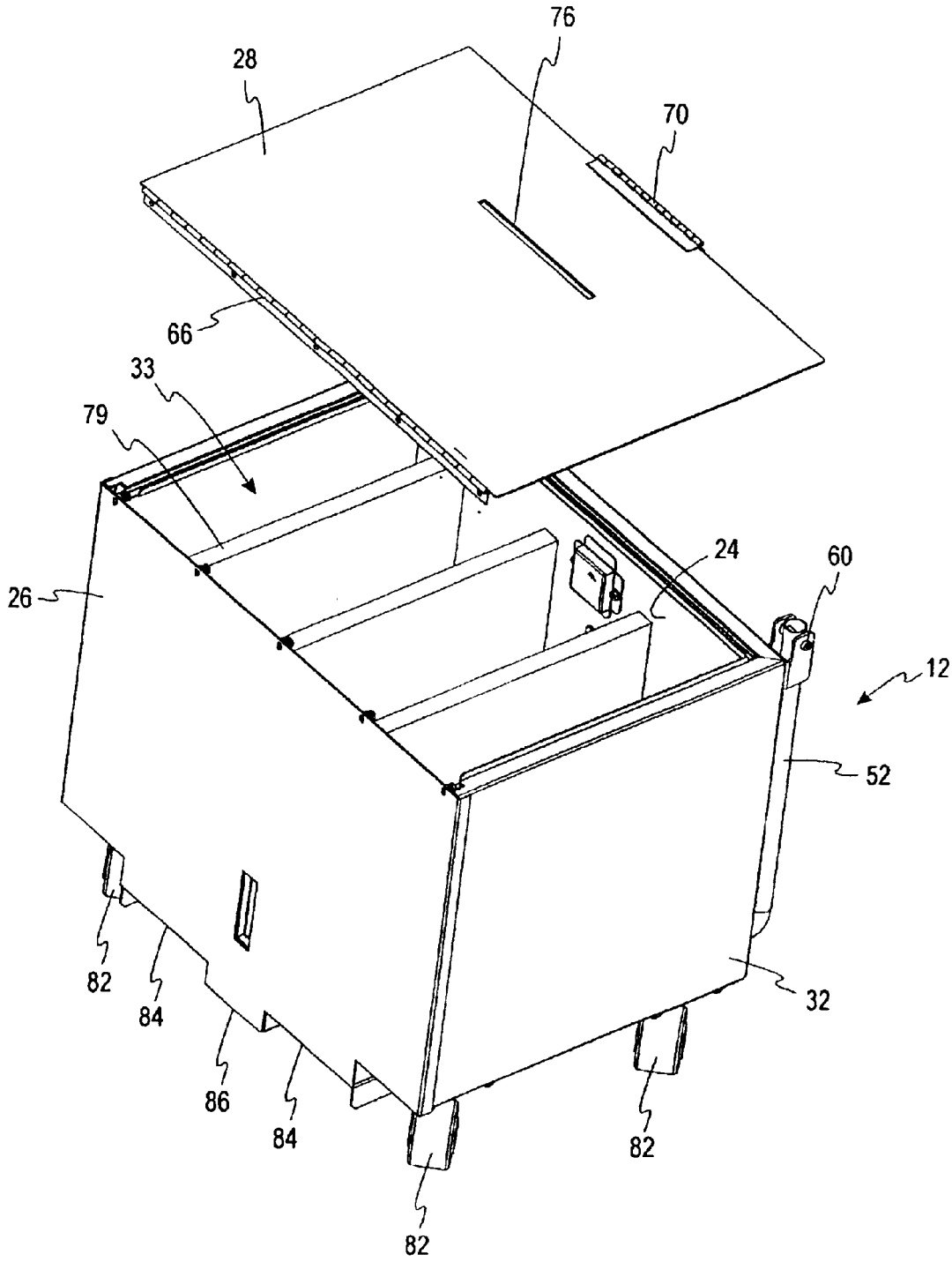
FIG. 3*c* is the same as FIG. 3*a* except that it includes a plurality of compartments.
Figure 3D:
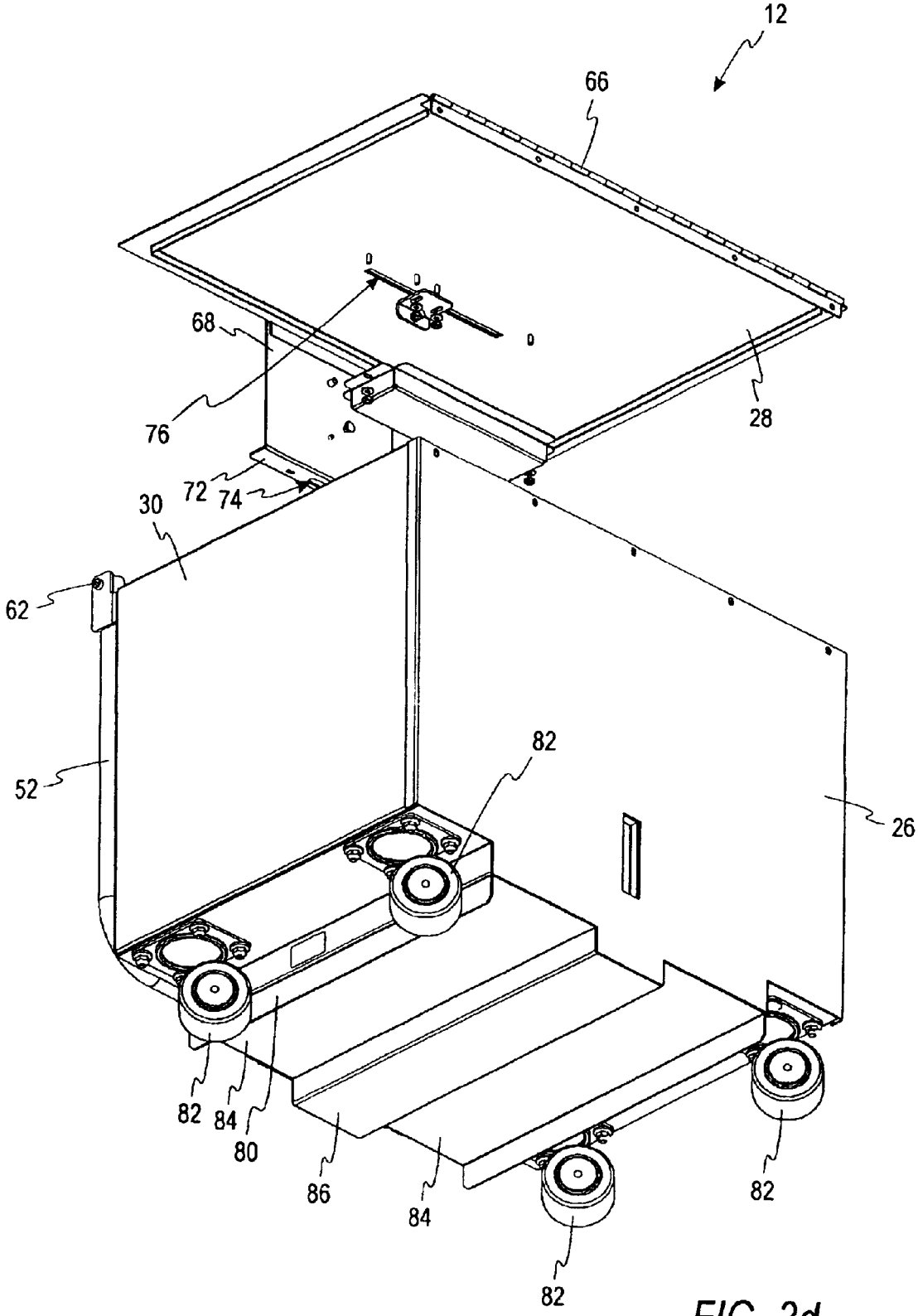
FIG. 3*d* is a bottom-perspective view of FIG. 3*a.*

In another embodiment the coin bin 12 includes a number of separating plates 79 for dividing the coin bin 12 into a plurality of compartments (FIG. 3*c*). The compartments can be used to sort the coins by denomination, or to contain bags for holding a smaller number of coins. The bags contain in general less coins and are therefore lighter in weight than the coin bin 12, making them easier to transport. The compartments may comprise a plurality of compartment doors for controlling the flow of said coins in each compartment, wherein each one of the compartment doors is individually moveable.

The coin bin 12 also includes a bottom plate 80 which includes a plurality of wheels 82. Four wheels 82 are located in each corner of the bottom plate 80 to facilitate the easy movement of the coin bin 12 from one place to another. The wheels 82 are readily available commercial casters, selected to withstand the several hundred pound weight of the coins and coin bin 12. In other embodiments, the number of wheels varies from two wheels to as many as desired.

In another embodiment, the bottom plate 80 preferably has a number of grooves 84 which are separated by a central bar 86. Each one of the grooves 84 and the central bar 86 has two ends which form a longer dimension, the length, and are oriented such that one end of the length is near the front plate 24 while the other end is near the back plate 26 One of the functions of the grooves 84 is to allow the transportation of the coin bin 12 by using a forklift device, such as a hand or a motorized truck. In other embodiments two more side bars can be located parallel to the central bar 86 such that they restrict the forklift device from moving sideways, towards the wheels 82.

In other embodiments of the present invention, any one or more of the sloped surface 78, the front plate 24, the first side plate 30, the second side plate 32, the back plate 26, the cover 28, and the separating plates can be covered with a laminated material having multiple layers. The laminated material has two outer layers which are made of a metal, and a thin inner layer which is made of a non-metal that holds the outer two layers together. The thin inner layer serves to dampen the vibrations of coins impacting the outer layers. The inner layer converts the vibrational energy into thermal energy. The laminated material comes in a variety of thicknesses, with the smallest one being about 0.04 inch and the largest being about 0.375 inch. Preferably, the laminated material is a stainless steel. Such materials are available through various sources, including Classic Sheet Metal in Schiller Park, Ill. A laminated material similar to the one that was described above is described in greater detail in U.S. patent application Ser. No. 09/812,334 entitled "Coin Processing Machine Having Coin-Impact Surfaces Made From Laminated Metal," which was filed on Mar. 19, 2001 and is incorporated herein by reference in its entirety.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A removable coin storage apparatus being used in a coin processing device, said apparatus comprising:

a removable bin comprising a first opening and a second opening;

a cover for said first opening being movable between a closed position wherein said cover substantially covers said first opening, and an open position wherein said cover at least partially uncovers said first opening to allow the placement of coins inside said bin through said first opening;

a gate mounted to said bin and movable between an up position and a down position, said gate while in said up position at least partially uncovering said second opening to allow said coins to be discharged from said bin, said gate while in said down position substantially covering said second opening; and a sloped floor inside said bin having a plurality of planes, said floor providing a gravity-induced flow of said coins toward said second opening;

wherein said sloped floor is defined at least in part with a laminated metal.

2. The apparatus of claim 1, wherein said coin processing device is a coin redemption machine.

3. The apparatus of claim 1, wherein said gate is adjustable to control the flow of said coins.

4. The apparatus of claim 1, wherein said gate comprises a plurality of settings for controlling the flow of said coins.

5. A removable coin storage apparatus being used in a coin processing device, said apparatus comprising:

a removable bin comprising a first opening and a second opening;

a cover for said first opening being movable between a closed position wherein said cover substantially covers said first opening, and an open position wherein said cover at least partially uncovers said first opening to allow the placement of coins inside said bin through said first opening;

a gate mounted to said bin and movable between an up position and a down position, said gate while in said up position at least partially uncovering said second opening to allow said coins to be discharged from said bin, said gate while in said down position substantially covering said second opening; and a sloped floor inside said bin having a plurality of planes, said floor providing a gravity-induced flow of said coins toward said second opening;

wherein said bin is being defined at least in part by a laminated metal on at least some of a plurality of interior surfaces.

6. A portable coin storage apparatus being used in a coin processing device, said apparatus comprising:

a portable bin comprising a first opening to allow the placement of coins inside said bin, and a second opening to allow said coins to be discharged from said bin;

a cover for covering said first opening;

a gate mounted to said bin for covering said second opening;

a sloped surface inside said bin having a plurality of planes, said surface providing a gravity-induced flow of said coins toward said second opening; and a plurality of compartments for sorting said coins by category, said compartments being separated by a plurality of plates, each of said compartments being accessible to said second opening, wherein said portable bin is inserted in a coin processing device when receiving said coins and wherein said portable bin is removed from said coin processing device when retrieving said coins.

7. The apparatus of claim 6, wherein said coin processing device is a coin redemption machine.

8. The apparatus of claim 6, wherein said gate is adjustable to control the flow of said coins.

9. The apparatus of claim 6, further comprising a plurality of compartment doors for controlling the flow of said coins, said doors being individually moveable for each of said compartments.

10. The apparatus of claim 6, wherein said plates are being defined at least in part with a laminated metal.

11. The apparatus of claim 6, wherein said sloped surface is being defined at least in part with a laminated metal.

12. A portable coin storage apparatus, comprising:

a portable receptacle for receiving coins comprising a first opening and a second opening;

a lid for covering said first opening;

a door mounted to said receptacle for covering said second opening; and a single-locking mechanism for securing said door to said lid so that neither said door nor said lid can be opened to access said coins, wherein said portable receptacle is inserted in a coin processing device when receiving said coins and wherein said portable receptacle is removed from said coin processing device when retrieving said coins.

13. The apparatus of claim 12, wherein said locking mechanism comprises a padlock.

14. The apparatus of claim 12, wherein said locking mechanism is located on a front exterior surface of said receptacle.

15. The apparatus of claim 12, wherein said locking mechanism comprises a locking plate, said plate being connected to said lid, said plate having an aperture for allowing a lock to secure said plate to said door.

16. The apparatus of claim 12, wherein said door comprises a locking surface being located perpendicular to said door, said locking surface comprising a first locking hole for allowing a lock to secure said first locking hole to a second locking hole, wherein said second locking hole is located on a locking plate, said locking plate being connected to said lid.

17. The apparatus of claim 12, wherein said door further comprises a first ridge having a first locking bole, and wherein said lid further comprises a locking plate having a second ridge, said second ridge including a second locking hole, said first locking hole and said second locking hole being movable to a locking position to allow a single-locking device to secure said apparatus.

18. A portable coin storage apparatus, comprising:

a receptacle for receiving coins comprising a first opening and a second opening;

a lid for covering said first opening;

a door mounted to said receptacle for covering said second opening; and a single-locking mechanism for securing said door to said lid so that neither said door nor said lid can be opened to access said coins, said locking mechanism having a locking plate, said plate being connected to said lid, said plate having an aperture for allowing a lock to secure said plate to said door.

19. A portable coin storage apparatus, comprising:

a receptacle for receiving coins comprising a first opening and a second opening;

a lid for covering said first opening;

a door mounted to said receptacle for covering said second opening, said door having a locking surface being located perpendicular to said door, said locking surface comprising a first locking hole for allowing a lock to secure said first locking hole to a second locking hole, wherein said second locking hole is located on a locking plate, said locking plate being connected to said lid; and a single-locking mechanism for securing said door to said lid so that neither said door nor said lid can be opened to access said coins.

20. A portable coin storage apparatus, comprising:

a receptacle for receiving coins comprising a first opening and a second opening;

a lid for covering said first opening, said lid including a locking plate having a second ridge, said second ridge including a first locking hole;

a door mounted to said receptacle for covering said second opening, said door including a first ridge having a second locking hole, said first locking hole and said second locking hole being movable to a locking position to allow a single-locking device to secure said apparatus; and a single-locking mechanism for securing said door to said lid so that neither said door nor said lid can be opened to access said coins.

* * * * *